US006705204B2

(12) United States Patent
Miyazawa et al.

(10) Patent No.: US 6,705,204 B2
(45) Date of Patent: Mar. 16, 2004

(54) SWASH PLATE-TYPE

(75) Inventors: Kiyoshi Miyazawa, Isesaki (JP); Masatoshi Sagiya, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/157,869

(22) Filed: May 31, 2002

(65) Prior Publication Data

US 2003/0024381 A1 Feb. 6, 2003

(30) Foreign Application Priority Data

Jul. 31, 2001 (JP) ..... P2001-232172

(51) Int. Cl.[7] ..... F04B 27/08
(52) U.S. Cl. ..... 92/71; 417/269
(58) Field of Search ..... 92/71, 12.2; 91/499; 417/269

(56) References Cited

U.S. PATENT DOCUMENTS 4,641,570 A * 2/1987 Futamura et al. ..... 92/71
4,683,804 A * 8/1987 Futamura et al. ..... 92/71
5,483,867 A 1/1996 Ikeda et al.
5,950,480 A 9/1999 Fukushima
6,168,389 B1 1/2001 Fukushima
6,276,905 B1 8/2001 Yoshitaka
6,371,007 B1 4/2002 Ootsuki
6,477,938 B1 * 11/2002 Nakayama et al. ..... 92/71

* cited by examiner

*Primary Examiner*—Thomas E. Lazo
(74) *Attorney, Agent, or Firm*—Baker Botts L.L.P.

(57) ABSTRACT

A swash plate-type compressor includes a cylinder block, a drive shaft, a swash plate, a plurality of pistons, and a pair of shoes. The cylinder block has a plurality of cylinder bores formed therethrough. The drive shaft is rotatably supported by the cylinder block. The swash plate is mounted on the drive shaft for rotation therewith. Each of the plurality of pistons is slidably positioned within a respective one of the cylinder bores to reciprocate therein. Each of the pistons has a pair of substantially semispherical cavities formed at an end thereof. A pair of shoes is positioned between each of the pistons and the swash plate. Each shoe has a semispherical portion adapted to be positioned within one of the substantially semispherical cavities of the pistons and a flat portion slidable along a surface of the swash plate. A first concave portion is formed in the flat portion. A second concave portion is formed in the semispherical portion.

23 Claims, 1 Drawing Sheet

SWASH PLATE-TYPE

BACKGROUND OF THE INVENTION

1. Field of the Invention

The present invention relates to swash plate-type compressors, and more particularly, to semispherical shoes provided between a swash plate and pistons of a swash plate-type compressor.

2. Description of Related Art

Known swash plate-type compressors are used for air conditioning systems of vehicles. Such known swash plate-type compressors may comprise a cylinder block, a front housing, and a cylinder head. The cylinder block includes a plurality of cylinder bores arranged in an annular configuration around a central axis of the cylinder block. The front housing is attached to one end surface of the cylinder block to form a crank chamber. The cylinder head is attached to another end surface of the cylinder block, via a valve plate, and forms a suction chamber and a discharge chamber. The front housing, the cylinder block, the valve plate, and the cylinder head may be attached by a plurality of bolts. The known swash plate-type compressor further comprises a drive shaft, a swash plate, a plurality of pistons, a plurality of pairs of hemispherical shoes, a suction valve, and a discharge valve. The drive shaft is supported rotatably by a central portion of the cylinder block and the front housing. The drive shaft extends through the crank chamber along a central axis of the compressor. The swash plate is mounted slidably on the drive shaft and rotates with the drive shaft. A piston is slidably positioned in each cylinder bore to reciprocate therein. Each piston includes a pair of shoe-receiving portions at one end. A pair of shoes is positioned within each pair of shoe-receiving portions. Moreover, each pair of shoes slidably contacts side surfaces of a circumferential portion of the swash plate, so that each piston is operatively connected to the swash plate by means of a pair of shoes, and so that each piston may reciprocate in a cylinder bore. The suction valve controls the introduction of a refrigerant, e.g., a refrigerant gas, to each cylinder bore. The discharge valve controls the discharge of refrigerant from each cylinder bore.

In such known swash plate-type compressors, each shoe has a substantially hemispherical configuration. Each shoe comprises a flat surface portion that contacts the swash plate, e.g., a side surface of the swash plate, and a hemispherical surface portion that contacts a shoe-receiving portion of the piston. A rectilinear chamfered portion is formed at a joint portion between the flat surface portion and the hemispherical portion.

The reciprocating components of such known swash plate-type compressors include the pistons, the shoes, and the swash plate. Thus, the inertial force of the reciprocating components during compressor operation may be proportionate to the weight of the pistons, the shoes, and the swash plate.

If such known swash plate-type compressors are variable displacement, swash plate-type compressors, the inertial force of the reciprocating components may affect the angle of inclination between the swash plate and the drive shaft during compressor operation. If a discharge capacity of the compressor is to be reduced during compressor operation, the inclination angle between the swash plate and the drive shaft may be increased. Moreover, pressure in the compressor crank chamber may be increased to increase the angle of inclination and reduce the compressor discharge capacity.

However, the pressure increase in the compressor crank chamber may have to overcome an inertial force of the reciprocating components to increase the inclination angle of the swash plate. Further, the inertial force of the reciprocating components may contribute to compressor vibration during operation of swash plate-type compressors.

SUMMARY OF THE INVENTION

Therefore, a need has arisen to reduce a weight of one or more reciprocating components of swash plate-type compressors, so that the inertial force of the reciprocating components during compressor operation may be reduced. In particular, a need has arisen in variable displacement, swash plate-type compressors to reduce the weight of one or more reciprocating components, so that the discharge capacity of the compressors may be reduced more effectively. A further need has arisen to reduce the weight of one or more reciprocating components of swash plate-type compressors, so that a vibration of swash plate-type compressors may be reduced.

According to an embodiment of the present invention, a swash plate-type compressor comprises a cylinder block, a drive shaft, a swash plate, a plurality of pistons, and a plurality of pairs of shoes. The cylinder block has a plurality of cylinder bores formed therethrough. The drive shaft is rotatably supported by the cylinder block. The swash plate is mounted on the drive shaft and rotates therewith. Each of the pistons is slidably positioned within a respective one of the cylinder bores to reciprocate therein, and each of the pistons has a pair of substantially semispherical cavities formed at an end thereof. Each of the pairs of shoes is positioned between each of the plurality of pistons and the swash plate. Each shoe has a semispherical portion adapted to be positioned within one of the substantially semispherical cavities of the plurality of pistons and a flat portion slidable along a surface of the swash plate. A first concave portion is formed in the flat portion of each shoe. A second concave portion is formed in the semispherical portion of each shoe.

According to another embodiment of the invention, a compressor comprises a swash plate, a plurality of pistons, and a plurality of pairs of shoes. Each of the plurality of pistons includes a pair of substantially semispherical cavities formed at an end thereof. Each of the plurality of pairs of shoes includes a semispherical portion configured to be positioned within one of the substantially semispherical cavities of the plurality of pistons and a flat portion for contacting the swash plate. The semispherical portion of each shoe includes a first concave portion, and the flat portion includes a second concave portion.

Other objects, features, and advantages of embodiments of this invention will be understood by persons of ordinary skill in the art from the following detailed description of the invention and the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 1:
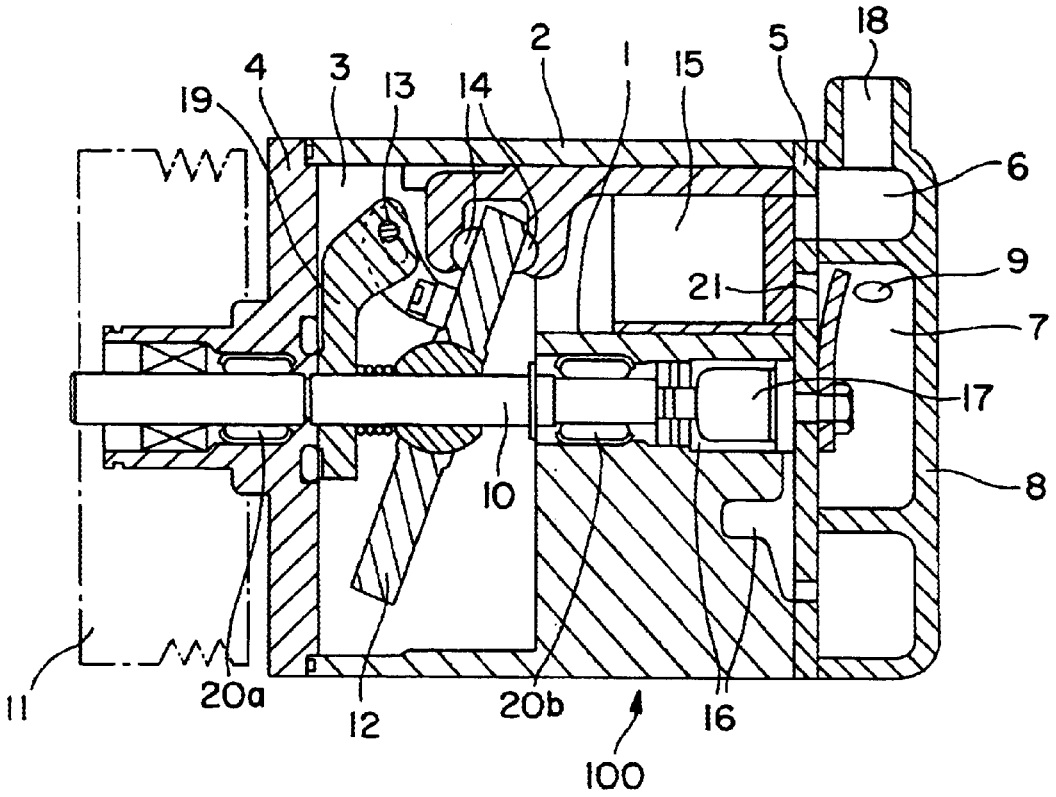
FIG. 1 is a longitudinal, cross-sectional view of a swash plate-type compressor, according to an embodiment of the present invention.

As shown in FIG. 1, a swash plate-type compressor 100 according to an embodiment of the present invention may comprise a cylinder block 2, a front housing 4, a valve plate 5, and a cylinder head 8. Cylinder block 2 may be substantially cylindrical. Front housing 4 may be positioned at one end of cylinder block 2. Cylinder head 8 and valve plate 5 may be positioned at another end of cylinder block 2. A crank chamber 3 may be formed between cylinder block 2 and front housing 4. Moreover, a suction chamber 6 and a discharge chamber 7 may be formed within cylinder head 8, adjacent to valve plate 5. Cylinder block 2, front housing 4, valve plate 5, and cylinder head 8 may be connected by a plurality of fasteners, e.g., bolts (not shown). Fluid communication may be established between crank chamber 3 and suction chamber 6 by a communication path 16. A capacity control valve 17 including a bellows (not shown) may be disposed within communication path 16 to open and close communication path 16. An inlet port 18 may communicate with suction chamber 6, and an outlet port 9 may communicate with discharge chamber 7. Inlet port 18 and outlet port 9 may be connected to and communicate with a refrigerant circuit (not shown) of a vehicle air conditioning system. Compressor 100 also may comprise a plurality of cylinder bores 1 formed in cylinder block 2. Cylinder bores 1 may be positioned around a central axis of cylinder block 2, e.g., in an annular configuration, and may be offset radially from the central axis of cylinder block 2.

Compressor 100 may comprise a drive shaft 10, a cam rotor 19, a swash plate 12, a plurality of pairs of shoes 14, and a plurality of pistons 15. Drive shaft 10 may extend through crank chamber 3, along a central axis of compressor 100. Drive shaft 10 may be supported rotatably by front housing 4 and cylinder block 2, via bearings 20*a* and 20*b*, which may be mounted in front housing 4 and cylinder block 2, respectively. Compressor 100 may comprise an electromagnetic clutch 11. A drive belt (not shown) may engage electromagnetic clutch 11 and transmit a driving force from a crankshaft of an engine of a vehicle (not shown) to electromagnetic clutch 11. When electromagnetic clutch 11 engages drive shaft 10, the driving force of the engine crankshaft may be transmitted by electromagnetic clutch 11 to drive shaft 10. Moreover, cam rotor 19 may be fixed to drive shaft 10 to rotate with drive shaft 10 and may be positioned within crank chamber 3. Swash plate 12 may be positioned within crank chamber 3 and may be slidably mounted on drive shaft 10. Swash plate 12 may be connected to cam rotor 19, via a hinge mechanism 13, such that an inclination angle of swash plate 12 may vary, and so that swash plate 12 may rotate with drive shaft 10.

A piston 15 may be positioned within each cylinder bore 1, so that each piston 15 may reciprocate independently within its respective cylinder bore 1. Each piston 15 includes a pair of substantially semispherical cavities formed at an end of each piston. Each piston 15 also may be connected to swash plate 12, via a pair of shoes 14, which may be positioned in the semispherical cavities of each piston 15 and which may contact a surface of swash plate 12, as shown in FIG. 1. Each shoe 14 may comprise a substantially flat portion and a substantially semispherical portion.

Figure 2:
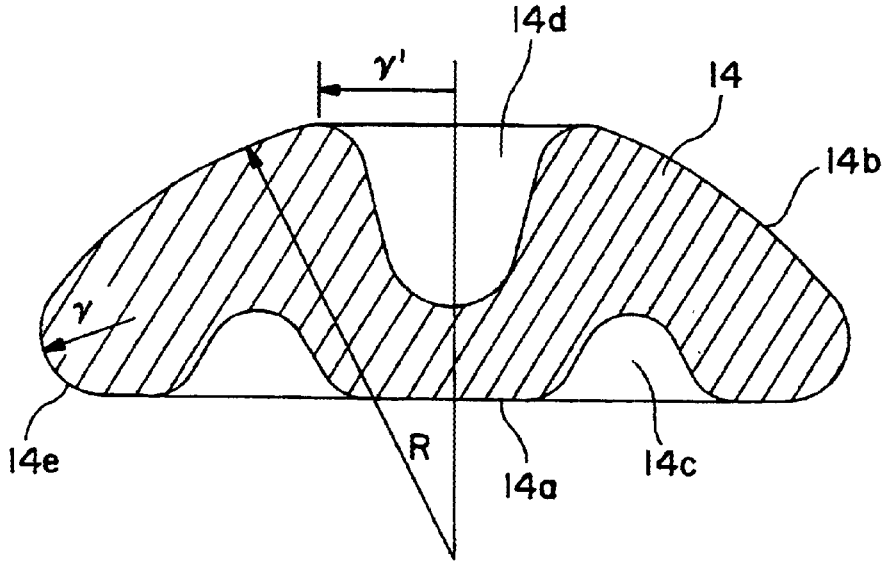
FIG. 2 is a cross-sectional view of a shoe depicted in FIG. 1, according to an embodiment of the present invention.

As shown in FIG. 2, each shoe 14 may comprise a substantially flat portion 14*a*. Flat portion 14*a* may slidably contact a surface of swash plate 12. An annular concave portion 14*c* may be formed in flat portion 14*a*. Shoe 14 also may include a substantially semispherical portion 14*b*. Semispherical portion 14*b* may be positioned in a substantially semispherical cavity formed at an end of piston 15. Semispherical portion 14*b* may rotate within a substantially semispherical cavity of a piston 15 A concave portion 14*d* may be formed in semispherical portion 14*b*, e.g., at a top of semispherical portion 14*b*. Formation of concave portion 14*d* in semispherical portion 14*b* may create an opening in a surface of semispherical portion 14*b* having a radius γ' that has a length between about 10% and about 30% of a spherical radius R of semispherical portion 14*b*. Moreover, a joint portion 14*e* may be formed along a junction of flat portion 14*a* and semispherical portion 14*b*. Joint portion 14*e* may include a curved surface, e.g., an arced, chamfered surface subtended by a radius γ that has a length between about 5% and about 15% of the spherical radius R of semispherical portion 14*b*.

Referring again to FIG. 1, in operation, when electromagnetic clutch 11 and drive shaft 10 are engaged, the driving force of the vehicle engine is transmitted to drive shaft 10, such that drive shaft 10, cam rotor 19, and swash plate 12 rotate about an axis of drive shaft 10. Specifically, rotation of drive shaft 10 is transmitted to cam rotor 19. Rotation of cam rotor 19 is transmitted to swash plate 12, via hinge mechanism 13, such that swash plate 12 rotates about an axis of drive shaft 10. Rotation of swash plate 12 causes each piston 15 to reciprocate within a respective cylinder bore 1. As each piston 15 reciprocates within its respective cylinder bore 1, a refrigerant, e.g., a refrigerant gas, may be drawn into suction chamber 6, via inlet port 18. Refrigerant further may be drawn from suction chamber 6 into each cylinder bore 1 and compressed. When refrigerant is compressed in a cylinder bore 1 by a piston 15, a discharge reed valve 21 may open, so that refrigerant may be discharged from each cylinder bore 1 into discharge chamber 7. Moreover, the refrigerant may be discharged from discharge chamber 7 to a refrigeration circuit, via outlet port 9.

During reciprocation of pistons 15 in cylinder bores 1, some refrigerant may flow between sliding portions of piston 15 and cylinder 1. The refrigerant may flow to crank chamber 3. The presence of this refrigerant, i.e., blow-by gas, in crank chamber 3 may increase the pressure in crank chamber 3. Eventually, the pressure of refrigerant in crank chamber 3 may exceed a charged pressure in the bellows of capacity control valve 17, causing the bellows to contract. When the bellows contract, fluid communication may be established between crank chamber 3 and suction chamber 6, via communication path 16 and capacity control valve 17, so that refrigerant in crank chamber 3 may flow to suction chamber 6. As a result, the pressure in crank chamber 3 may decrease. When the pressure in crank chamber 3 decreases to a level that is less than the charged pressure in the bellows of capacity control valve 17, the bellows may expand. When the bellows of capacity control valve 17 expand, the bellows may close communication path 16, so that refrigerant in crank chamber 3 may not flow to suction chamber 6. As a result, the pressure of refrigerant in crank chamber 3 may begin to increase as blow-by gas flows into crank chamber 3.

When the pressure in crank chamber 3 increases, e.g., due to the presence blow-by gas, an angle of inclination between swash plate 12 and drive shaft 10 may increase. As a result, a stroke of each piston 15 may decrease, and a discharge capacity of compressor 100 may decrease. In contrast, when the pressure in crank chamber 3 decreases, the inclination angle between swash plate 12 and drive shaft 10 may decrease. As a result, the stroke of each piston 15 may increase, and the discharge capacity of compressor 100 may increase. As described above, capacity control valve 17 may control the pressure in crank chamber 3 by opening and closing communication path 16 to establish fluid communication between crank chamber 3 and suction chamber 6. By controlling the pressure in crank chamber 3, capacity control valve 17 may control the inclination angle between swash plate 12 and drive shaft 10. As a result, the length of a stroke of each piston 15 may be controlled, and the discharge capacity of compressor 100 may be controlled, as well.

As shown in FIG. 2, an annular concave portion 14*c* is formed at flat portion 14*a* of shoe 14 and a concave portion 14*d* may be formed at a top of semispherical portion 14*b* of shoe 14. As a result, a weight of each shoe 14 may be reduced. By reducing the weight of each shoe 14, an inertial force of the reciprocating components, which include shoes 14, may be reduced. Therefore, in compressor 100, because the weight, and, thus, the inertial force, of the reciprocating components is reduced compared to known compressors, the inclination angle between swash plate 12 and drive shaft 10 may not decrease as much during compressor operation, as occurs in known compressors. Thus, the inclination angle between swash plate 12 and drive shaft 10 may be increased and the discharge capacity of compressor 100 may be reduced more readily during compressor operation. Moreover, in compressor 100, because an inertial force of reciprocating components, including shoes 14, may be reduced, a vibration of compressor 100 may be reduced, as well.

In compressor 100, radius γ' of concave portion 14*d* may be defined as less than about 30% of the spherical radius R of semispherical portion 14*b*. As a result, semispherical portion 14*b* includes a sufficient semispherical surface to maintain an adequate area of contact with a substantially semispherical cavity of piston 15, so that an occurrence of seizures or scoring at the contact area may be reduced or eliminated. Moreover, because the radius γ' of concave portion 14*d* may be defined as greater than about 10% of the spherical radius R of semispherical portion 14*b*, the weight of shoe 14 may be reduced sufficiently.

During operation, swash plate-type compressor 100 may start and stop intermittently, e.g., when a vehicle air conditioning system turns on and off, or the like. If a joint portion is formed at a junction of a flat surface portion and a semispherical portion of a shoe with a linearly-chamfered edge, as in known swash plate-type compressors, the joint portion may damage, e.g., cut into, a surface of a swash plate, when a known swash plate-type compressor is activated. As a result, the swash plate of known swash plate-type compressors may be damaged. In contrast, in the embodiment of the present invention, joint portion 14*e* may be formed along a junction of flat surface 14*a* and semispherical portion 14*b* with a curved, e.g., an arced, chamfered surface. When compressor 100 is activated, the curved, chamfered surface of joint portion 14*e* may not cut into or otherwise damage a surface of swash plate 12. As a result, swash plate 12 of compressor 100 may not be damaged.

In compressor 100, because a radius γ of the curved surface of joint portion 14*e* may be greater than about 5% of the spherical radius R of semispherical portion 14*b*, a lubricant, e.g., a lubricating oil that may be suspended in the refrigerant, may flow to sliding portions, e.g., to bearing surfaces, of swash plate 12 and flat surface 14*a* of shoe 14, and to sliding portions of the substantially semispherical cavity of piston 15 and semispherical portion 14*b* of shoe 14, via the curved, chamfered joint portion 14*e*. Moreover, because a radius γ of the curved surface of joint portion 14*e* may be less than about 15% of the spherical radius R of semispherical portion 14*b*, flat portion 14*a* of shoe 14 may include an adequate surface area for contacting swash plate 12. As a result, contact pressure between flat portion 14*a* of shoe 14 and swash plate 12 may be maintained within an adequate range, such that abrasion of the sliding portions of flat portion 14*a* of shoe 14 and swash plate 12 may be effectively reduced or eliminated.

As described above, according to an embodiment of the present invention of swash plate-type compressor 100, an annular concave portion 14*c* may be formed in flat portion 14*a* and a concave portion 14*d* may be formed in semispherical portion 14*b*, e.g., at a top of semispherical portion 14*d*, of shoe 14. As a result, a weight of shoe 14 may be reduced, and an inertial force of the reciprocating components of compressor 100, including shoes 14, may be reduced, compared to known swash plate-type compressors. Therefore, in swash plate-type, variable displacement compressor 100, the inclination angle between swash plate 12 and drive shaft 10 of compressor 100 may decrease less than in known swash plate-type compressors due to the reduced inertial force of the reciprocating components of compressor 100 during compressor operation. Moreover, the pressure in crank chamber 3 may not have to be increased as much to increase the inclination angle of swash plate 12, as in known compressors in which the reciprocating components may have a greater inertial force than the reciprocating components of compressor 100 according to the invention. Thus, the inclination angle of swash plate 12 may be increased more effectively, so that the discharge capacity of compressor 100 may be reduced more readily during operation of the compressor according to the invention, than in known swash plate-type compressors.

Although the embodiment of the present invention has been described with respect to swash plate-type, variable displacement compressors, the present invention may be applied to swash plate-type, fixed displacement compressors.

While the invention has been described in connection with preferred embodiments, the invention is not limited thereto. It will be understood by those skilled in the art that other embodiments, variations and modifications of the invention will be apparent to those of ordinary skill in the art from a consideration of the specification or practice of the invention disclosed herein and may be made within the scope of the invention.

What is claimed is:

1. A swash plate-type compressor comprising:

a cylinder block having a plurality of cylinder bores formed therethrough;

a drive shaft rotatably supported by said cylinder block;

a swash plate mounted on said drive shaft and rotating therewith;

a plurality of pistons, wherein each of said plurality of pistons is slidably positioned within a respective one of said cylinder bores to reciprocate therein, and wherein each of said pistons has a pair of substantially semispherical cavities formed at an end thereof; and a plurality of pairs of shoes, each of said pairs of said shoes is positioned between each of said pistons and said swash plate, wherein each of said shoes has a semispherical portion adapted to be positioned within one of said substantially semispherical cavities of said plurality of pistons and a flat portion slidable along a surface of said swash plate, wherein a first concave portion is formed in said flat portion of each shoe, and a second concave portion is formed in said semispherical portion of each shoe, and wherein a radius of said second concave portion is between about 10% and about 30% of a radius of said semispherical portion.

2. The swash plate-type compressor of claim 1, wherein a joint portion is formed between said flat portion and said semispherical portion and comprises a curved, chamfered surface subtended by a radius with a length between about 5% and about 15% of a radius of said semispherical portion.

3. The swash plate-type compressor of claim 1, wherein said first concave portion comprises an annular shape formed in a surface of said flat portion.

4. The swash plate-type compressor of claim 1, wherein said compressor is a variable displacement compressor.

5. The swash plate-type compressor of claim 1, wherein said compressor is a fixed displacement compressor.

6. A swash plate-type compressor comprising:

a swash plate;

a plurality of pistons, wherein each of said pistons includes a pair of substantially semispherical cavities formed at an end thereof; and a plurality of pairs of shoes, wherein each of said pairs of shoes includes a semispherical portion configured to be positioned within one of said substantially semispherical cavities of said plurality of pistons and a flat portion for contacting said swash plate, wherein said flat portion includes a first concave portion and said semispherical portion includes a second concave portion, and wherein a radius of said second concave portion is between about 10% and about 30% of a radius of said semispherical portion.

7. The swash plate-type compressor of claim 6, wherein a joint portion is formed between said flat portion and said semispherical portion and comprises a curved, chamfered surface subtended by a radius with a length between about 5% and about 15% of a radius of said semispherical portion.

8. The swash plate-type compressor of claim 6, wherein said first concave portion comprises an annular shape formed in a surface of said flat portion.

9. The swash plate-type compressor of claim 6, wherein an apex of said second concave portion is offset from an apex of said first concave portion.

10. The swash plate-type compressor of claim 6, wherein said flat portion further includes a third concave portion.

11. The swash plate-type compressor of claim 10, wherein an apex of said second concave portion is offset from each of an apex of said first concave portion and an apex of said third concave portion.

12. A swash plate-type compressor comprising:

a swash plate;

a plurality of pistons, wherein each of said pistons includes a pair of substantially semispherical cavities formed at an end thereof and a plurality of pairs of shoes, wherein each of said pairs of shoes includes a semispherical portion configured to be positioned within one of said substantially semispherical cavities of said plurality of pistons and a flat portion for contacting said swash plate, wherein said flat portion includes a first concave portion and said semispherical portion includes a second concave portion, and wherein said first concave portion comprises an annular shape formed in a surface of said flat portion.

13. The swash plate-type compressor of claim 12, wherein a joint portion is formed between said flat portion and said semispherical portion and comprises a curved, chamfered surface subtended by a radius with a length between about 5% and about 15% of a radius of said semispherical portion.

14. The swash plate-type compressor of claim 12, wherein an apex of said second concave portion is offset from an apex of said first concave portion.

15. The swash plate-type compressor of claim 12, wherein said flat portion further includes a third concave portion.

16. The swash plate-type compressor of claim 15, wherein an apex of said second concave portion is offset from each of an apex of said first concave portion and an apex of said third concave portion.

17. A swash plate-type compressor comprising:

a swash plate;

a plurality of pistons, wherein each of said pistons includes a pair of substantially semispherical cavities formed at an end thereof; and a plurality of pairs of shoes, wherein each of said pairs of shoes includes a semispherical portion configured to be positioned within one of said substantially semispherical cavities of said plurality of pistons and a flat portion for contacting said swash plate, wherein said flat portion includes a first concave portion and said semispherical portion includes a second concave portion, and wherein a joint portion is formed between said flat portion and said semispherical portion and comprises a curved, chamfered surface subtended by a radius with a length between about 5% and about 15% of a radius of said semispherical portion.

18. The swash plate-type compressor of claim 17, wherein an apex of said second concave portion is offset from an apex of said first concave portion.

19. The swash plate-type compressor of claim 18, wherein said flat portion further includes a third concave portion.

20. The swash plate-type compressor of claim 19, wherein an apex of said second concave portion is offset from each of an apex of said first concave portion and an apex of said third concave portion.

21. The swash plate-type compressor of claim 19, wherein an apex of said second concave portion is offset from each of an apex of said first concave portion and an apex of said third concave portion.

22. The swash plate-type compressor of claim 18, wherein said flat portion further includes a third concave portion.

23. A swash plate-type compressor comprising:

a swash plate;

a plurality of pistons, wherein each of said pistons includes a pair of substantially semispherical cavities formed at an end thereof; and a plurality of pairs of shoes, wherein each of said pairs of shoes includes a semispherical portion configured to be positioned within one of said substantially semispherical cavities of said plurality of pistons and a flat portion for contacting said swash plate, wherein said flat portion includes a first concave portion and said semispherical portion includes a second concave portion, and wherein an apex of said second concave portion is offset from an apex of said first concave portion.

* * * * *